United States Patent [19]

Spangler

[11] 4,046,075

[45] Sept. 6, 1977

[54] FUSEE CAP CLOSURE

[75] Inventor: Perry Kay Spangler, Denver, Ind.

[73] Assignee: Olin Corporation, New Haven, Conn.

[21] Appl. No.: 708,827

[22] Filed: July 26, 1976

[51] Int. Cl.[2] ..... F42B 4/26

[52] U.S. Cl. ..... 102/37.8

[58] Field of Search ..... 102/37.8, 37.4

[56] References Cited

U.S. PATENT DOCUMENTS

| | | | |
|---|---|---|---|
| 853,777 | 5/1907 | Dutcher | 102/37.8 |
| 1,103,279 | 7/1914 | Edmands | 102/37.8 |
| 1,489,900 | 4/1924 | Ross | 102/37.8 |
| 2,545,275 | 3/1951 | Griffith | 102/37.8 |
| 3,528,370 | 9/1970 | Gaither et al. | 102/37.8 |

*Primary Examiner*—Charles T. Jordan

*Attorney, Agent, or Firm*—William W. Jones; Paul J. Lerner

[57] ABSTRACT

A closure for a fusee which comprises a body of pyrotechnic material which is contained in a main paper tube and has a primed igniting end surface. The primed end is covered by a secondary paper tube having a wood button insert on the outer end surface of which is deposited scratch mix. The secondary paper tube is secured to the main paper tube by a layer of hot melt which can be manually broken to remove the secondary paper tube from the main paper tube. The secondary paper tube is covered by a paper cup having an integral pressure ring. The cup is secured to the secondary paper tube by a layer of hot melt which can be manually broken to remove the paper cup from the secondary paper tube.

1 Claim, 1 Drawing Figure

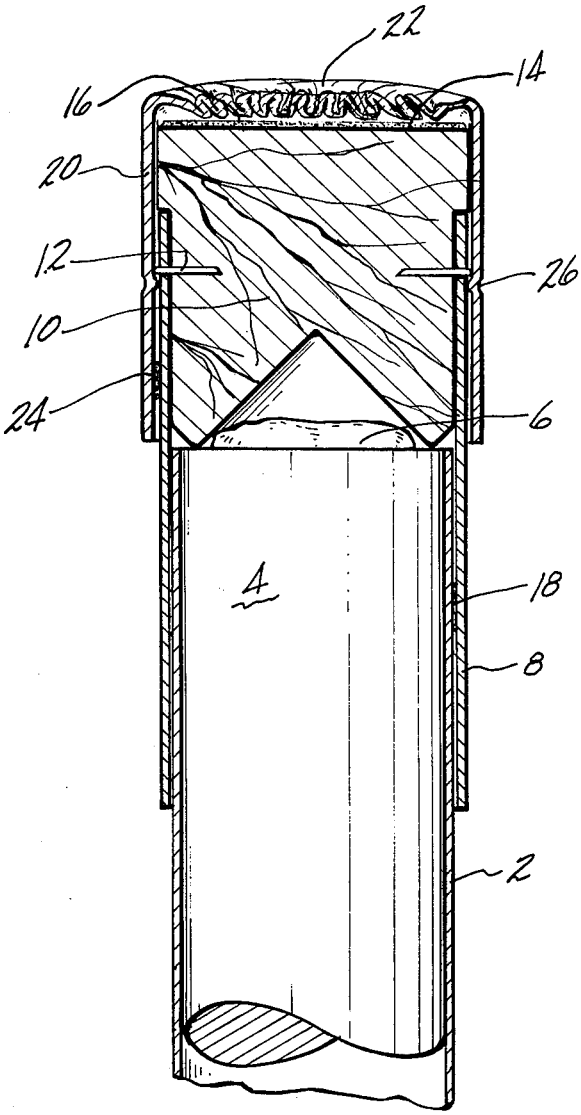
22
14
16
20
12
26
10
24
6
4
18
8
2

FUSEE CAP CLOSURE

This invention relates to an end closure structure for a fusee or flare.

Certain types of prior art fusees have their ignition ends closed by means of a paper bonnet which is draped over a scratch mix-coated tube and which extends over the entire length of the scratch mix tube down onto the main fusee tube. A fabric strip, termed the cambric, is disposed under the paper bonnet and extends from the lower end thereof. The paper bonnet is adhered to the main fusee tube and the scratch mix tube by means of paste or the like adhesive. The fusee is opened for use by pulling on the cambric to tear the paper bonnet which is then pulled away to expose the scratch mix tube. The latter is then pulled off of the main fusee tube to expose an end of the pyrotechnic which is ignited to burn the fusee. This general type of closure is illustrated in U.S. Pat. No. 2,090,911, among others.

Ths prior art fusee closure system is expensive, and requires special equipment to install due to the presence of the cambric tear strip.

This invention relates to a less expensive and improved fusee closure structure which is made of paper and which does not require a cambric tear strip as a component thereof. The closure structure of this invention includes the conventional scratch mix tube which is releasably secured to the main fusee tube. Covering the scratch mix tube is a paper cup which is releasably secured to the scratch mix tube by means of an adhesive, such as a hot melt resin. The closure structure is removed from the fusee by twisting the paper cup to break the adhesive coating, and then pulling the cup off of the scratch mix tube. The scratch mix tube is then twisted to break its adhesive securement and the scratch mix tube is pulled off of the main fusee tube to expose the primed end of the pyrotechnic for ignition by the scratch mix.

It is, therefore, an object of this invention to provide a closure structure for the ignition end of a fusee, which closure structure does not include a paper bonnet and a cambric tear strip.

It is further object of this invention to provide a closure structure of the character described which employs a scratch mix tube telescoped over the ignition end of the pyrotechnic core of the fusee and releasably secured thereto by adhesive, and a paper cup telescoped over the scratch mix tube and releasably secured thereto by adhesive.

It is yet another object of this invention to provide a closure structure of the character described which is inexpensive to manufacture and assemble and simple to open to use the fusee.

These and other objects and advantages of the invention will become more readily apparent from the following detailed description of a preferred embodiment thereof taken in conjunction with the accompanying drawing which is an axial sectional view of the ignition end portion of a fusee embodying the closure structure of this invention.

Referring now to the drawing, the fusee includes a main fusee tube 2 which is made of paper and which contains a cylindrical body 4 of pyrotechnic material which burns to produce light and/or smoke when the fusee is ignited. An ignition button 6 of primer material is deposited on the upper end surface of the pyrotechnic material 4. An open ended paper tube 8 is telescoped over the main fusee tube 2 and extends above and beyond the ignition button 6. A wooden insert 10 is disposed inside of the tube 8 and secured thereto by a pair of staples 12. On the upper surface 14 of the insert 10 there is deposited a layer of scratch mix which is used to ignite the pyrotechnic material 4 by being rubbed over the ignition button 6. A spot of adhesive 18 releasably secures the tube 8 to the main fusee tube 2. For purposes of identification, the tube 8 hereinafter will be referred to as the scratch mix tube. A paper cup 20 is telescoped over the scratch mix tube 8 and has a spun-in closed upper end 22 which overlies the scratch mix layer 16. A spot of adhesive 24 releasably secures the paper closure cup 20 to the scratch mix tube 8. There is also formed in the side wall of the cup 20 a pressure ring 26 which frictionally engages the adjacent side wall of the scratch mix tube 8.

After the several component parts of the fusee are assembled, the scratch mix tube 8 is telescoped over the main fusee body 2 and the adhesive spot 18 is applied to releasably secure the tube 8 to the fusee body 2. The cup 20 is then telescoped over the scratch mix tube 8 and the adhesive spot 24 is applied to releasably secure the cup 20 to the scratch mix tube 8.

To use the fusee, one twists the cup 20 to break the adhesive spot 24 and pulls the cup 20 off of the scratch mix tube 8. The scratch mix tube 8 is then twisted to break the adhesive spot 18, and the tube 8 is pulled off of the fusee body 2 to expose the priming button 6. The scratch mix layer 16 is then rubbed over the priming button 6 to ignite the latter and thereby ignite the pyrotechnic material 4. Any known means can be used for positioning the ignited fusee on a supporting surface.

It will be readily appreciated that the fusee construction of this invention is not complex, is inexpensive, and easy to assemble and disassemble. Adequate protection is provided for the ingnition button and scratch mix layer without requiring the use of a cambric tear strip and paper bonnet.

Since many changes and variations of the disclosed embodiment of the invention maybe made without departing from the inventive concept, it is not intended to limit the invention otherwise than as required by the appended claims.

What is claimed is:

1. A closure for a fusee having a cylindrical mass of pyrotechnic material encased in a main paper tube and having an end surface upon which is deposited an ignition coating of primer material, said closure comprising:

a. an open-ended paper tube telescoped over said main paper tube and extending beyond said primer-coated end surface of said pyrotechnic material, said open-ended paper tube containing a wooden insert which is secured to said open-ended paper tube and which overlies said primer-coated end surface of said pyrotechnic material, an outer end surface of said wooden insert being coated with a layer of scratch mix, and said open-ended paper tube being releasably secured to said main paper tube with an adhesive material; and b. a paper cup having a spun-in closed end, said cup being telescoped over said open-ended paper tube with said spun-in closed end overlying said layer of scratch mix, said paper cup being formed with an inwardly crimped annular pressure ring on its side wall for frictionally engaging said open-ended paper tube, and said paper cup being releasably secured to said open-ended paper tube with an adhesive material.

* * * * *

UNITED STATES PATENT OFFICE

CERTIFICATE OF CORRECTION

Patent No. 4,046,075 Dated September 6, 1977

Inventor(s) Perry Kay Spangler

It is certified that error appears in the above-identified patent and that said Letters Patent are hereby corrected as shown below:

Col. 1, line 21, change "Ths" to -- This --.

Col. 2, line 4, after the word "layer" please insert --16--;

Col. 2, line 36, change "ingnition" to --ignition--.

Signed and Sealed this

*Fourteenth* Day of *October 1980*

[SEAL]

*Attest:*

SIDNEY A. DIAMOND

*Attesting Officer*

*Commissioner of Patents and Trademarks*